US006174414B1

(12) United States Patent
Theriault

(10) Patent No.: US 6,174,414 B1
(45) Date of Patent: Jan. 16, 2001

(54) HIGH PRESSURE RECIPROCATING SUCTION ROLL SHOWER

(75) Inventor: Raymond Theriault, Masson-Angers (CA)

(73) Assignee: Bowater Pulp and Paper Canada Inc. (CA)

( * ) Notice: Under 35 U.S.C. 154(b), the term of this patent shall be extended for 0 days.

(21) Appl. No.: 09/243,214

(22) Filed: Feb. 2, 1999

(30) Foreign Application Priority Data

Feb. 1, 1999 (CA) ..... 2261085

(51) Int. Cl.[7] ..... D21F 3/10; D21F 1/34

(52) U.S. Cl. ..... 162/278; 162/277; 162/369

(58) Field of Search ..... 162/276, 277, 162/278, 275, 368, 369, 370

(56) References Cited

U.S. PATENT DOCUMENTS

| | | | | |
|---|---|---|---|---|
| 1,507,608 | * | 9/1924 | Kidd | 162/277 |
| 1,586,358 | | 5/1926 | Eurich . | |
| 1,814,864 | | 7/1931 | Sinclair . | |
| 1,840,102 | | 1/1932 | Jespersen . | |
| 2,772,606 | * | 12/1956 | Kelly | 162/371 |
| 3,190,793 | | 6/1965 | Starke | 162/278 |
| 3,300,374 | * | 1/1967 | Baker et al. | 162/371 |
| 3,630,838 | | 12/1971 | Bryand et al. | 162/371 |
| 4,167,440 | | 9/1979 | Falk | 162/277 |
| 4,753,712 | * | 6/1988 | Martin et al. | 162/277 |
| 4,975,150 | | 12/1990 | Yasuda et al. | 162/199 |
| 5,466,343 | * | 11/1995 | Kankaanpaa | 162/372 |
| 5,494,227 | | 2/1996 | Costantini . | |

* cited by examiner

*Primary Examiner*—Karen M. Hastings
(74) *Attorney, Agent, or Firm*—Jon Carl Gealow

(57) ABSTRACT

A high pressure shower system for cleaning perforations in a suction roll of a paper-making machine is disclosed. An elongated header pipe is mounted to the outside of the suction box and is fitted with a plurality of spaced high pressure nozzles directed at and in close proximity to the inside surface of the suction roll. The header pipe is driven in a longitudinal reciprocating manner providing complete spray coverage of the suction roll perforations. The water supply conduit to the header passes through the inside of the suction box which has a sealed slot opening to accommodate the reciprocal movement of the header.

10 Claims, 3 Drawing Sheets

HIGH PRESSURE RECIPROCATING SUCTION ROLL SHOWER

FIELD OF THE INVENTION

The present invention relates to a shower system for suction rolls used in papermaking machines.

BACKGROUND OF THE INVENTION

In paper making machines, suction rolls are commonly used to extract water from the wet paper web before it leaves the felt in the wet forming section of the paper making machine. The suction roll comprises a cylindrical metal shell in which a large number of small evenly spaced holes are formed. The suction roll typically rotates in contact with the felt at web speed and direction. Suction is applied to the inside surface of the roll by means of a suction box. The suction box is an elongated tube inside the suction roll and is fixed against rotation. The suction box has a longitudinal slot which is in sealing engagement with the inside surface of the suction roll. As the rotating inside surface of the suction roll passes over the slot, suction is applied through the holes to assist in de-watering the felt and thereby reduce the water content of the wet paper web.

Plugging of the suction roll holes is a commonly encountered problem. The "white water" extracted from the felt contains substantial insoluble components which tend to build up in the suction roll holes. Unless the suction roll is cleaned periodically, this build-up can lead to complete plugging of the suction roll. In such a case, the suction roll must be removed from the paper-making machine and the holes must be manually cleared. This is typically achieved either by manually punching out the obstruction on each hole with a hammer and punch. Given that there are hundreds of thousands of holes in a conventional suction roll, this operation is time consuming and the labour and downtime associated therewith is costly. In addition, such an operation carries with it the risk of damaging the suction roll.

There exist a number of known methods and apparatus which are intended to prevent the build-up of deposits during the paper-making operation and thereby avoid or make less frequent the requirement to manually clear the suction roll holes. For example, in U.S. Pat. No. 4,975,150 Yasuda et al. there is disclosed a method of preventing the plugging of a suction roll with makes use of the conventional fan sprays which are conventionally fitted inside the suction roll. These fan sprays apply a coating of white water to the inside surface of the suction roll to improve sealing and reduce friction between the suction box slot opening and the inside surface of the suction roll. While the pressure of the fan head spray is insufficient to dislodge deposits in the suction roll holes, Yasuda et al. disclose the use of maleic acid in the fan spray as an anti-plugging agent.

It is also known to provide a dedicated high pressure spray head to clean various perforated elements. For example, in U.S. Pat. No. 5,494,227 Costantini, there is disclosed a shower system having an arcuate array of high pressure spray nozzles mounted for lateral reciprocal movement across a screen which functions to separate pulp by size. Similarly, in U.S. Pat. No. 4,167,440 Falk there is disclosed a high pressure reciprocating spray cleaning apparatus for foraminous elements.

It is also known to provide cleaning fluid in a dedicated pressure chamber located inside the suction box for the purpose of cleaning felts. For example, in U.S. Pat. No. 1,840,102 Jespersen, there is disclosed a pressure chamber which extends across the width of the suction roll and applies water under pressure through the suction roll perforations to clean the felt. Similarly, in U.S. Pat. No. 3,190,793 Starke, there is disclosed a pressure chamber employing cleaning fluid subject to high frequency oscillations to clean paper making machine felts.

None of these known systems disclose any means to provide a high pressure cleaning fluid into a suction box for cleaning the perforations in a rotating suction roll.

SUMMARY OF THE INVENTION

In accordance with the present invention, there is provided a high pressure shower system for cleaning perforations in a suction roll. The shower system comprises a header pipe extending longitudinally in the annular space between the suction box and the inside surface of said cylinder; a plurality of spray nozzles disposed along said header pipe in close spaced relation with said inside surface, each spray nozzle having a spray axis aligned on a radius of said cylinder; a means for driving said header pipe in longitudinal reciprocating movement; and a means for supplying high pressure fluid to said header pipe for discharge through said nozzles into said perforations. The header pipe is mounted for reciprocal longitudinal movement on brackets fixed to said suction box and the brackets partially encircle the header pipe with the opening in the brackets permitting reciprocal movement of said nozzle without interfering with the spray discharge. The spray nozzles are uniformly disposed along said header pipe at a spacing equal to or less than the stroke length of said longitudinal reciprocal movement. The bracket can includes a wear resistant low friction material in sliding contact with said header pipe. A conduit means is connected to the header pipe and passes into the interior of the suction chamber through an elongated slot in the side of said chamber adjacent to said header pipe and passes out of the suction chamber through an end plate.

BRIEF DESCRIPTION OF THE DRAWINGS

In drawings which illustrate embodiments of the invention.

DESCRIPTION OF THE PREFERRED EMBODIMENT

Figure 1:
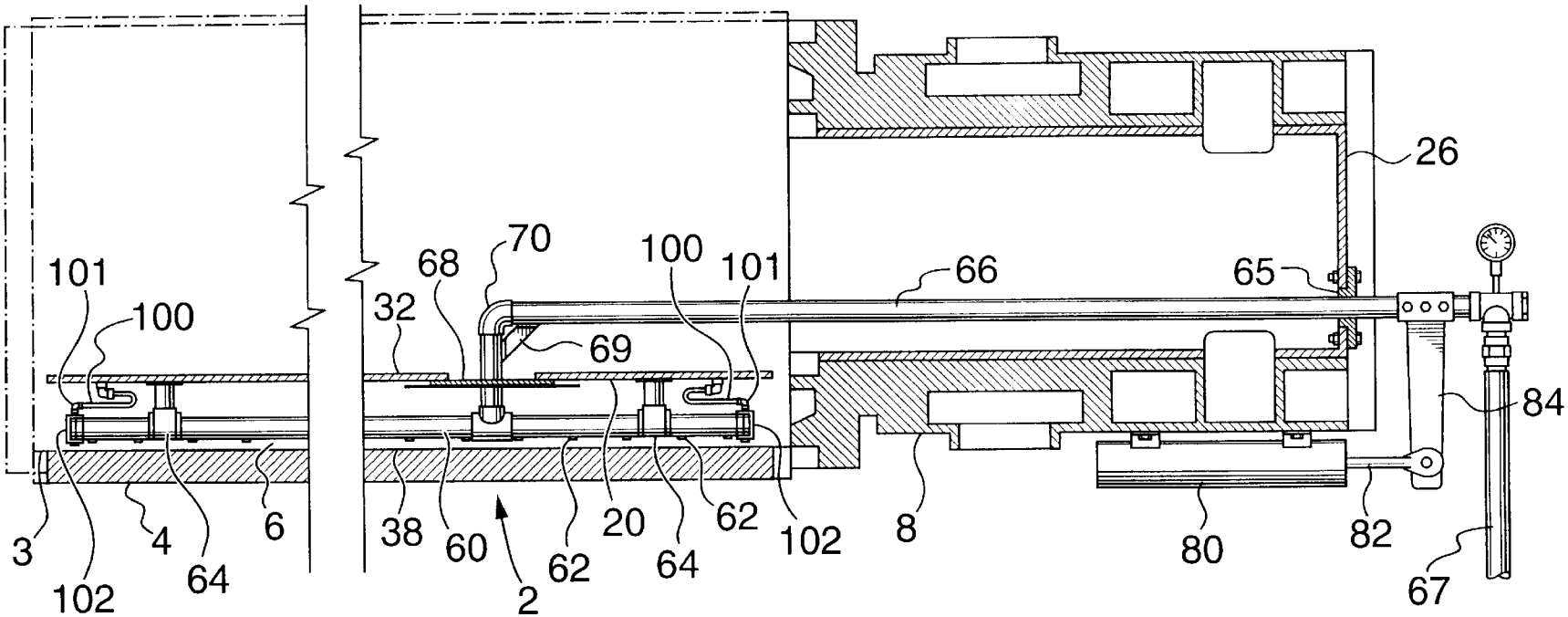
FIG. 1 is an elevational view in part cross-section showing a suction roll fitted with the high pressure shower system of the present invention.

Referring to FIG. 1, there is shown in part cross-section, suction roll 2 is an elongated cylinder having stainless steel cylindrical wall 3 and rubber surface 4 bonded to its outer surface.

Perforations 6 are drilled radially through wall 3 and rubber surface 4 in a close set uniform pattern over substantially the entire surface. In conventional papermaking machines, suction roll 2 can be 33 feet wide and 36 inches in diameter with cylindrical wall 3 being about 2½ inches thick. Suction roll 2 is mounted for rotation about its horizontal longitudinal axis. Each end of suction roll 2 is supported for rotation in end assembly 8 at each end, one of which is shown in FIG. 1.

Figure 2:
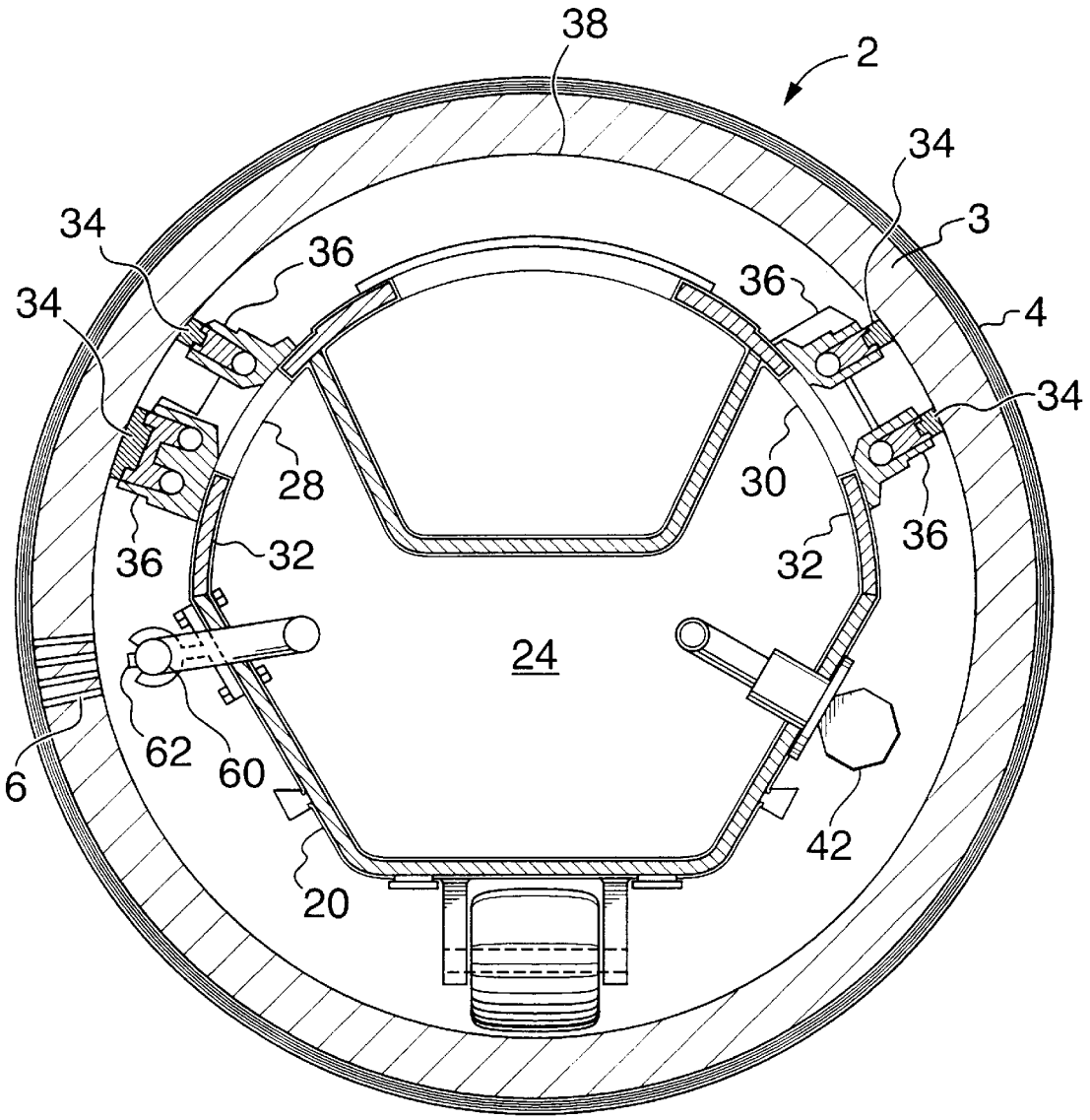
FIG. 2 is a transverse cross-sectional view of a suction roll suction roll fitted with the high pressure shower system of the present invention.

As shown in FIG. 2, suction box 20 is positioned longitudinally along the central axis within suction roll 2 and is fixed against rotation at each end to bearing end assembly 8. Vacuum is applied to suction chamber 24 within suction box 20 by means of an appropriate suction line (not shown) which passes through fixed end wall 26 of end assembly 8. In conventional installations, a vacuum of from about 18 to 23 inches Hg is common.

Walls 32 of suction box 20 are spaced approximately 6 inches inside cylindrical wall 3 of suction roll 2. Suction chamber 24 has slots 28, 30 formed longitudinally through walls 32. Flanges 36 are project radially outward on either side of slots 28, 30 and carry on their radially outer surfaces elastomeric seals 34 in sliding contact with the inside surface 38 of rotating suction roll 2. Vacuum in suction chamber 24 is applied to the inside surface 38 of suction roll 2 through slots 28, 30 and draws water from the felt (not shown) in contact with the rubber surface 4 of suction roll 2 through perforations 6 into suction chamber 24 and out through the suction line.

In order to reduce friction between elastomeric seals 34 and inside surface 38 of suction roll 2, to improve the vacuum seal there between and to clean out accumulated debris, suction box 20 is fitted with a plurality of fan spray heads 42 which direct water under low pressure against the inside surface 38 of suction roll 2. Fan spray heads 42 are mounted at uniform intervals along a header pipe (not shown) which extends longitudinally along the outside of suction box 20. The spacing interval and spray pattern are such as to provide a relatively uniform application of water to inside surface 38 along the length of suction roll 2. A suitable source of low pressure water (not shown) is piped through fixed end wall 26 of end assembly 8 and is connected to header pipe 43 through wall 32.

Thus far described, the suction roll arrangement is conventional. In operation, fibres, fillers and other particulate matter present in the white water extracted from the felt tends over time to plug perforations 6 in suction roll 2. Eventually, the perforations become plugged to such an extent that suction roll 2 must be removed from the papermaking machine and each perforation must be manually cleared, typically by a laborious hammer and punch operation. In accordance with the present invention, there is provided a high pressure spray shower which operates to continuously clean the perforations 6 in suction roll 2 and greatly reduce or eliminate the requirement for manual cleaning.

Referring again to FIG. 1, the high pressure spray shower of the present invention includes header pipe 60 which is mounted longitudinally along the outside of suction box 20. Header pipe 60 is fitted with a plurality of spray nozzles 62 evenly spaced along its length. Spray nozzles 62 are in close proximity (approx. ¾ to 1 inch) to the inside surface 38 of suction roll 2 and are aligned to direct a needle like jet of fluid in a radial direction into the bore of suction roll perforations 6 as they rotate past the nozzle. Spray nozzles 62 are preferably formed of stainless steel and drilled with a 0.040 inch orifice.

Figures 3, 4:
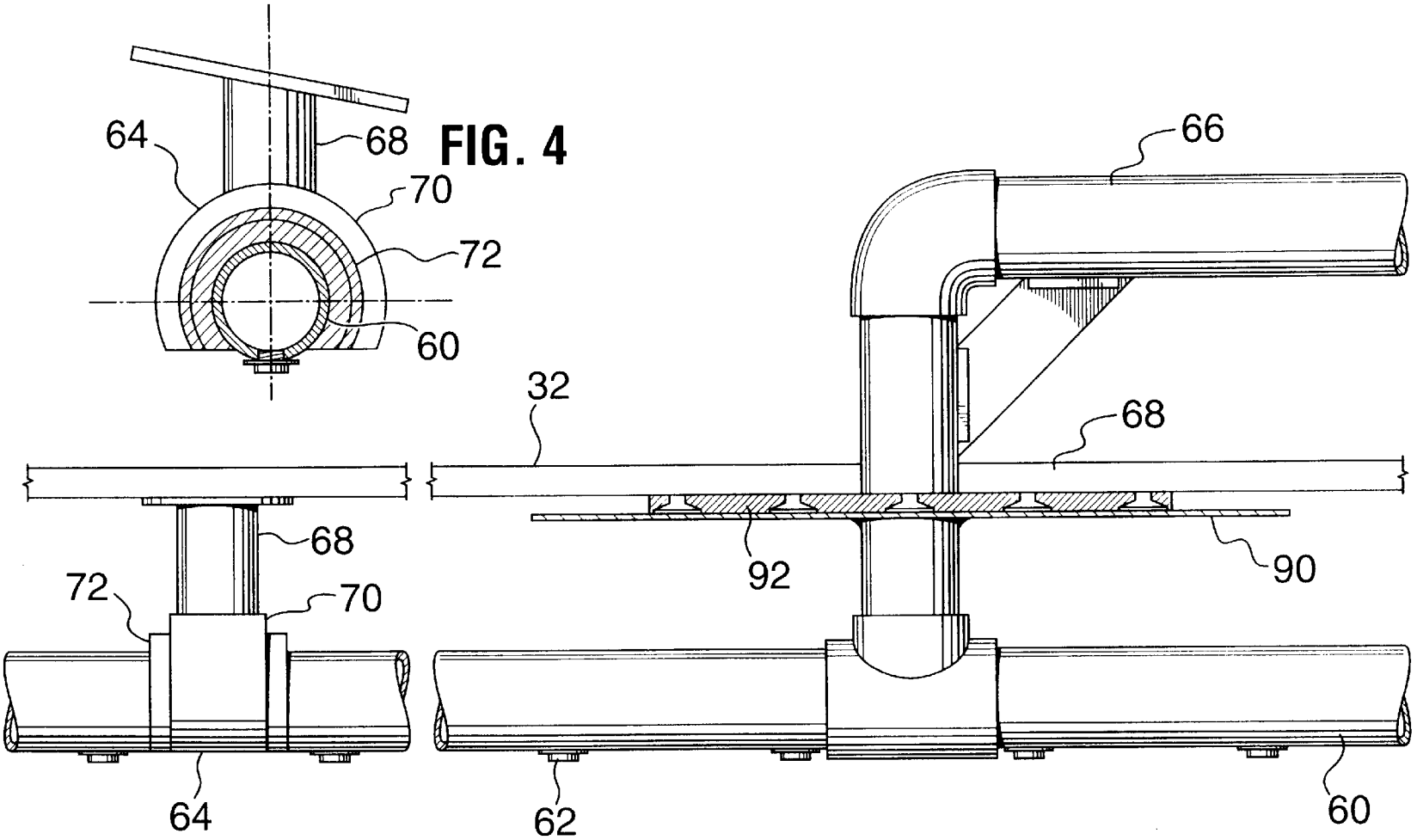
FIG. 3 is a plan view showing the spray header and the associated bracket and sealing details of the present invention.
FIG. 4 is a transverse cross-sectional view of the bracket and spray header of the present invention.

Header pipe 60 is mounted for reciprocating motion along its longitudinal axis to the outside wall 32 of suction box 20 by means of brackets 64. As best shown in FIGS. 3 and 4, brackets 64 comprise stand-off 68, collar 70 and bearing sleeve 72. Header pipe 60 is slidably received in bearing sleeve 72 which is formed of a suitable wear resistant low friction material such as Teflon™ to facilitate the reciprocating movement. Bearing sleeve 72 and collar 70 only partially encircle header pipe 60 so as not to obstruct or interfere with the reciprocating movement or the spray of nozzles 62.

Header pipe 60 is connected to supply pipe 66 through elongated slot 68 in wall 32 of suction box 20. Supply pipe 66 passes through pressure seal 65 in fixed end wall 26 of bearing end assembly 8 and is connected to a source of high pressure water (approx. 350 psi) through flexible high pressure feed hose 67.

Oscillator 80 is fixed to bearing end assembly 8 and is of a conventional hydraulic design. Stroke rod 82 is connected to supply pipe 66 by link arm 84. Stroke rod 82 is driven in a reciprocating linear action by oscillator 80 which causes supply pipe 66 to move in a reciprocating manner through pressure seal 65. Elongated slot 68, pressure seal 65 and flexible high pressure feed hose 67 permit supply pipe 66 to move reciprocally and act as a fixed link to drive header pipe 60 along its longitudinal axis. Angle brace 69 can be used to strengthen corner 70 of supply pipe 66.

The spacing between spray nozzles 62 is fixed at slightly less than the stroke length of oscillator 80. This provides at least some overlap in the areas covered by adjacent spray nozzles at the limits of their reciprocal motion thus ensuring that all perforations will be exposed to the high pressure spray. For example, with an oscillator having a stroke length of about 6¼ inches, a centre spacing of about 6 inches between spray nozzles 62 is suitable.

In order to ensure proper operation of suction roll 2, it is necessary to limit the loss of vacuum in suction box 20 through elongated slot 68 To achieve this, sealing plate 90 is fixed to supply pipe 66 and closely overlies elongated slot 68. Gasket 92 is fixed to suction box 20 around elongated slot 68, for example by way of countersunk bolts. Gasket 92 is advantageously formed of a thin sheet of a suitable wear resistant low friction material such as Teflon™. When vacuum is applied inside suction box 20, sealing plate 90 is drawn into sealing engagement with gasket 92 to reduce vacuum loss. In addition, the low friction nature of gasket 92 facilitates the reciprocating sliding movement of sealing plate 90 over gasket 92 and reduces stress on oscillator 80 and supply pipe 66. It has been found in practice that gasket 92 can suitably be formed from a sheet of ½ inch thick Teflon™ and extend about 1–2 inches beyond the edges of elongated slot 68. Sealing plate 90 can suitably be formed from ⅛ inch thick stainless steel plate of a generally rectangular configuration and of sufficient length to maintain coverage of gasket 92 at opposite limits of stroke.

In operation, contaminants in the high pressure spray water tends to accumulate in the ends of header pipe 60 and plug the spray nozzles 62 adjacent the ends. In a preferred embodiment of the present invention, the ends of header pipe 60 are connected to the interior of suction box 20 by flexible bleed lines 100. Bleed lines 100 are flexible high pressure hydraulic lines of a suitably small diameter, (e,g, ⅜ inch). Bleed lines 100 are attached to high pressure fittings 101 which are threaded into a drilled orifice (e.g., ⅛ inch) in each end cap 102 which closes off the end of header pipe 60 and into a drilled orifice (e.g., ⅜ inch) in wall 32 of suction box 20. Bleed lines 100 are of sufficient length to flexibly accommodate the entire stroke length of header pipe 60. The flow of high pressure fluid through bleed line 100 carries contaminant build-up out of the ends of header pipe 60 into suction box 20, thereby avoiding plugging of the spray nozzles 62 located adjacent the ends of header pipe 60.

While the above description includes the use of fan spray heads 42 to lubricate the elastomeric seals 34 and inside surface 38 of suction roll 2, the high pressure spray shower of the present invention itself provides lubrication to the and permits the fan spray heads 42 to be eliminated, if desired.

While the present invention has been described with reference to the embodiment shown in the drawings, it will be understood that many variations are possible and come within the scope of the claims set out below.

What is claimed is:

1. A high pressure shower system in combination with and for cleaning perforations in a suction roll, said suction roll comprising an elongated cylindrical shell supported for rotation about its longitudinal axis, an elongated suction box concentrically supported within said cylindrical shell and fixed against rotation with respect thereto, said suction box comprising an elongated suction chamber, at least one elongated suction slot conduit means in sealing engagement with the rotating inside surface of said cylinder and a vacuum source connected to the interior of said chamber, said shower system comprising:

a header pipe extending longitudinally in the annular space between the suction box and the inside surface of said cylinder;

a plurality of spray nozzles disposed along said header pipe in close spaced relation with said inside surface, each spray nozzle having a spray axis aligned on a radius of said cylinder;

conduit means for supplying high pressure fluid to said header pipe for discharge through said nozzles into said perforations, said conduit means connected to said header pipe and passing into the interior of said suction chamber through an elongated slot in the side of said suction box adjacent to said header pipe and passing out of said suction chamber through an opening in the end plate of said suction box;

means for driving said header pipe and said conduit means in longitudinal reciprocating movement; and sealing means for sealing said elongated slot against loss of vacuum around said reciprocating conduit means.

2. The shower system of claim 1 wherein said header pipe is mounted for reciprocal longitudinal movement on brackets fixed to said suction box.

3. The shower system of claim 2 wherein each said bracket partially encircles said header pipe, the opening in each said bracket permitting reciprocal movement of said nozzle without interfering with said discharge.

4. The shower system of claim 3 wherein each said bracket includes a wear resistance low friction material in sliding contact with said header pipe.

5. The shower system of claim 1 wherein said spray nozzles are uniformly disposed along said header pipe at a spacing equal to or less than the stroke length of said longitudinal reciprocal movement.

6. The shower system of claim 1 wherein said sealing means comprises a plate fixed to said conduit means and overlying said slot, said plate being of a sufficient size to maintain coverage of said slot at opposite limits of said longitudinal reciprocating movement, whereby said plate is drawn into sealing engagement with the side of said suction box by application of vacuum in said suction chamber.

7. The shower system of claim 6 wherein said sealing means further comprises a gasket fixed to said suction box around said elongated slot against which said plate is drawn into sealing engagement.

8. The shower system of claim 7 wherein said gasket is formed of a wear resistant low friction material.

9. The shower system of claim 1 wherein the ends of said header pipe are connected to said suction chamber by flexible bleed lines of a length sufficient to accommodate said longitudinal reciprocating movement, whereby contaminant build-up in said ends is carried by high pressure fluid through said bleed lines into said suction chamber.

10. The shower system of claim 1 wherein said means for driving said header pipe and said conduit means is connected to said conduit means outside said end plate of said suction box and said conduit means acts as a fixed link to drive said header pipe in longitudinal reciprocating motion.

* * * * *